US010030660B1

(12) United States Patent
Mehta et al.

(10) Patent No.: US 10,030,660 B1
(45) Date of Patent: Jul. 24, 2018

(54) PULSATION AND VIBRATION CONTROL DEVICE

(71) Applicant: TRANE INTERNATIONAL INC., Davidson, NC (US)

(72) Inventors: Pavak Mehta, La Crescent, MN (US); William B. Rockwood, Mindoro, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 15/609,450

(22) Filed: May 31, 2017

(51) Int. Cl.

| | |
|---|---|
| ***F01N 1/08*** | (2006.01) |
| ***F16F 7/112*** | (2006.01) |
| ***F16F 7/104*** | (2006.01) |
| ***F16L 27/10*** | (2006.01) |
| ***F16L 27/12*** | (2006.01) |
| ***F04C 29/06*** | (2006.01) |
| *F01N 1/00* | (2006.01) |
| *F16F 7/10* | (2006.01) |

(52) U.S. Cl.
CPC ..... *F04C 29/065* (2013.01)

(58) Field of Classification Search
CPC ..... F04C 29/06; F04C 29/065; F01N 1/083; F01N 1/089; F04B 39/0027; F04B 39/0044; F04B 39/0061; F04B 39/0072; F04B 53/001; F24F 13/24; F24F 1/12; F24F 2013/245; F16L 27/10; F16L 27/11; F16L 27/1012; F16L 3/16; F16L 3/18; F16L 3/01; F16F 7/112; F16F 7/104
See application file for complete search history.

(56) References Cited

U.S. PATENT DOCUMENTS 1,496,509 A * 6/1924 Abell ..... F01N 1/083 138/38
1,505,121 A * 8/1924 Allport ..... F16L 51/028 138/121
2,877,860 A * 3/1959 Hoffar ..... F01N 1/083 116/DIG. 18

(Continued)

FOREIGN PATENT DOCUMENTS

CN 201193902 2/2009
CN 201589393 U 9/2010

(Continued)

OTHER PUBLICATIONS

International Search Report issued in International Application No. PCT/US2013/055601 dated Dec. 17, 2013 (3 pages).

(Continued)

*Primary Examiner* — Edgardo San Martin
(74) *Attorney, Agent, or Firm* — Hamre, Schumann, Mueller & Larson, P.C.

(57) ABSTRACT

A pulsation and vibration control device for use with a compressor, which provides multiple vibration-reducing components in a compact space. The device comprises a muffler including a flange at the compressor end, a muffler body with vibration control features such as baffles, and a free end on a discharge line side but kept out of contact with the discharge line, and a bellows assembly, including an attachment to the muffler flange, an attachment to the discharge line, and first and second convolutions and a middle section which are sized such that they can fit over the muffler body without contacting it.

20 Claims, 5 Drawing Sheets

(56) References Cited

U.S. PATENT DOCUMENTS 3,113,635 A 12/1963 Allen et al.
3,171,506 A * 3/1965 Hald ..... F04B 39/0055 181/265
3,470,979 A * 10/1969 Everett ..... F16L 55/02709 181/268
3,705,734 A * 12/1972 Rajakovics ..... F16L 27/12 285/226
3,948,348 A 4/1976 Bychinsky
3,948,349 A 4/1976 Bychinsky
4,165,798 A 8/1979 Martinez
4,359,134 A 11/1982 Jackson
4,508,486 A 4/1985 Tinker
4,600,076 A 7/1986 Yamamoto et al.
4,920,746 A * 5/1990 Gebelius ..... F01N 1/083 181/231
5,183,974 A 2/1993 Wilhem et al.
5,272,285 A 12/1993 Miller
5,274,200 A 12/1993 Das et al.
5,519,994 A 5/1996 Hill
5,653,478 A * 8/1997 McGurk ..... F01N 13/1816 285/227
5,694,926 A 12/1997 DeVries et al.
5,804,775 A 9/1998 Pinnington
5,997,258 A 12/1999 Sawyer et al.
6,032,463 A * 3/2000 Bock ..... F01N 13/10 285/226
6,062,033 A 5/2000 Choi
6,116,374 A 9/2000 Westerbeke, Jr.
6,145,616 A 11/2000 Ewanek
6,425,742 B1 * 7/2002 Fukuda ..... F01N 1/089 181/212
6,508,681 B1 * 1/2003 Neisen ..... B63H 20/245 285/226
7,278,834 B2 10/2007 Herrick et al.
7,318,608 B2 1/2008 Swartz et al.
7,357,219 B2 4/2008 Mafi et al.
7,380,635 B2 6/2008 Harris
7,503,426 B2 3/2009 Yaoita
7,526,903 B2 5/2009 Kandasamy
7,845,463 B2 12/2010 Yabe et al.
7,946,383 B2 5/2011 Lynch
8,061,475 B2 11/2011 Mori et al.
8,122,732 B2 2/2012 Lee
8,256,571 B1 * 9/2012 Butler ..... 181/268
8,434,586 B2 * 5/2013 Pawelski ..... F04C 29/065 181/175
9,175,648 B2 * 11/2015 Dobrin ..... F02M 35/1261
9,243,543 B2 * 1/2016 Bertrand ..... F01N 13/08
9,423,149 B2 * 8/2016 Martinus ..... F24F 13/24
2005/0006895 A1 1/2005 Muroi et al.
2005/0167189 A1 8/2005 Aisenbrey
2005/0274569 A1 12/2005 Seel
2006/0144637 A1 7/2006 Swartz et al.
2006/0197340 A1 * 9/2006 Senoo ..... F01N 13/1816 285/226
2006/0283657 A1 12/2006 Dubensky et al.
2007/0169504 A1 7/2007 Vinocur
2008/0099274 A1 5/2008 Seel
2008/0099275 A1 5/2008 Seel
2009/0065299 A1 3/2009 Vito et al.
2009/0184515 A1 * 7/2009 Argersinger ..... F16L 27/1021 285/229
2010/0070085 A1 3/2010 Harrod et al.
2010/0111713 A1 5/2010 Chatfield et al.
2010/0116583 A1 5/2010 Seedorf
2011/0017544 A1 1/2011 Bodwell et al.
2011/0067949 A1 3/2011 Mori et al.
2012/0193505 A1 8/2012 Baron
2015/0192310 A1 * 7/2015 Mehta ..... F24F 1/12 62/296

FOREIGN PATENT DOCUMENTS

DE 19530011 A1 * 2/1997 ..... F01N 13/1811
GB 191204463 A * 2/1913 ..... F01N 1/083
GB 2474683 B * 12/2015 ..... F01N 1/089
JP 55-45084 3/1980
JP 2007-035043 2/1995
JP 2000-199482 7/2000
JP 2000-240982 9/2000
JP 2009-293905 12/2009
KR 20-1990-0001060 2/1990
KR 10-2003-0050932 6/2003
KR 20-0390456 7/2005
KR 10-866173 10/2008

OTHER PUBLICATIONS

Written Opinion issued in International Application No. PCT/US2013/055601 dated Dec. 17, 2013 (8 pages).
International Search Report issued in International Application No. PCT/US2013/050065 dated Oct. 1, 2013 (3 pages).
Written Opinion issued in International Application No. PCT/US2013/050065 dated Oct. 1, 2013 (7 pages).

* cited by examiner

PULSATION AND VIBRATION CONTROL DEVICE

FIELD

This disclosure relates generally to devices for pulsation and vibration control for compressors in HVACR systems. More specifically, this disclosure relates to devices that may be installed between a compressor and a discharge line.

BACKGROUND

Quiet operation of compressors is of increasing importance as quieter and quieter compressors are demanded in the marketplace and in product specifications. Noise produced by compressors can result from multiple harmonics and different sources within the compressor. Current HVACR compressor systems may use a muffler assembly to reduce vibration and/or bellows to isolate parts of the chiller system from one another and damp some vibrations.

Compressors such as screw compressors may include vibration in both the structure of the compressor and its attached components, and in the fluid flowing out from the compressor. Structural and fluid vibrations may each be damped separately through different devices, such as mufflers for reducing fluid vibration, or bellows to mechanically isolate structural vibrations.

In many existing HVACR compressor systems that still have significant remaining operational lifetime, and in HVACR compressor system designs for installation into constrained spaces, there may not be sufficient room between the compressor and the discharge line to install both a bellows and a muffler. These space constraints may limit the extent of noise reduction that can be achieved in an HVACR compressor system where only a muffler or only a bellows system can be installed.

SUMMARY

A pulsation and vibration control device which includes a muffler unit having a flange on a compressor end, a muffler body, one or more vibration attenuation structures such as baffles within the muffler body, and a free end of the muffler opposite the compressor end, a bellows assembly which attaches to the flange and extends over the length of muffler body to a discharge line, and wherein the free end of the muffler and the discharge line do not contact one another.

In an embodiment, the vibration attenuation structure within the muffler body may be baffles which include a flange and a plate. In an embodiment, the size of the flange and plate and the angle of their attachment determined based on frequencies of vibration to be attenuated.

In an embodiment, the vibration attenuation structure includes a plurality of contracted portions of a path through the muffler body. The contracted portions may be in series and/or in parallel with one another.

In an embodiment, the muffler, bellows assembly, and discharge line may be joined together by bolts or welds. In an embodiment, the discharge line may have a discharge line flange that connects to the bellows assembly.

In an embodiment, the bellows assembly includes first and second convolutions joined by a connecting portion, and a mounting portion on each of the compressor side of the bellows assembly and the discharge line side of the bellows assembly.

In an embodiment, a system for pulsation and vibration control includes a muffler unit wherein the muffler has a muffler flange and a muffler body, which has an outer surface and contains at least one vibration attenuation structure, and a bellows assembly having a space with a volume larger than the volume defined by the outer surface of the muffler body.

In an embodiment, the system for pulsation and vibration control system may include a discharge line, and there is a gap between an end of the muffler body and the discharge line, with the gap being, for example, one quarter of an inch.

In an embodiment, the vibration attenuation structure may be baffles. In an embodiment, the baffles may include a flange and a plate. In an embodiment, the size of the flange and the plate and the angle of their attachment determined is based on frequencies of vibration to be attenuated.

In an embodiment, the vibration attenuation structure includes a plurality of contracted portions of a path through the muffler body. The contracted portions may be in series and/or in parallel with one another.

In an embodiment, the bellows assembly may include first and second convolutions joined by a connecting portion, and a mounting portion on each of the compressor side of the bellows assembly and the discharge line side of the bellows assembly.

DRAWINGS

DETAILED DESCRIPTION

An integrated design for muffler and bellows improves noise reduction within an HVACR compressor system such as a chiller, achieving a high degree of acoustic and vibration reduction. The integrated design includes a muffler unit having a flange on a compressor end, a muffler body containing one or more vibration attenuation structures, and a free end of the muffler body opposite the compressor end, a bellows assembly which attaches to the flange of the muffler unit and extends over the length of muffler body to a discharge line, and the free end of the muffler and the discharge line have a gap between them and do not contact one another. The integrated muffler and bellows assembly can be incorporated into existing HVACR system designs, for example by retrofitting the HVACR system, such as replacing either a bellows or a muffler with the integrated muffler and bellows assembly. The integrated muffler and bellows assembly can also be incorporated into new HVACR systems, for example during assembly.

Figure 1:
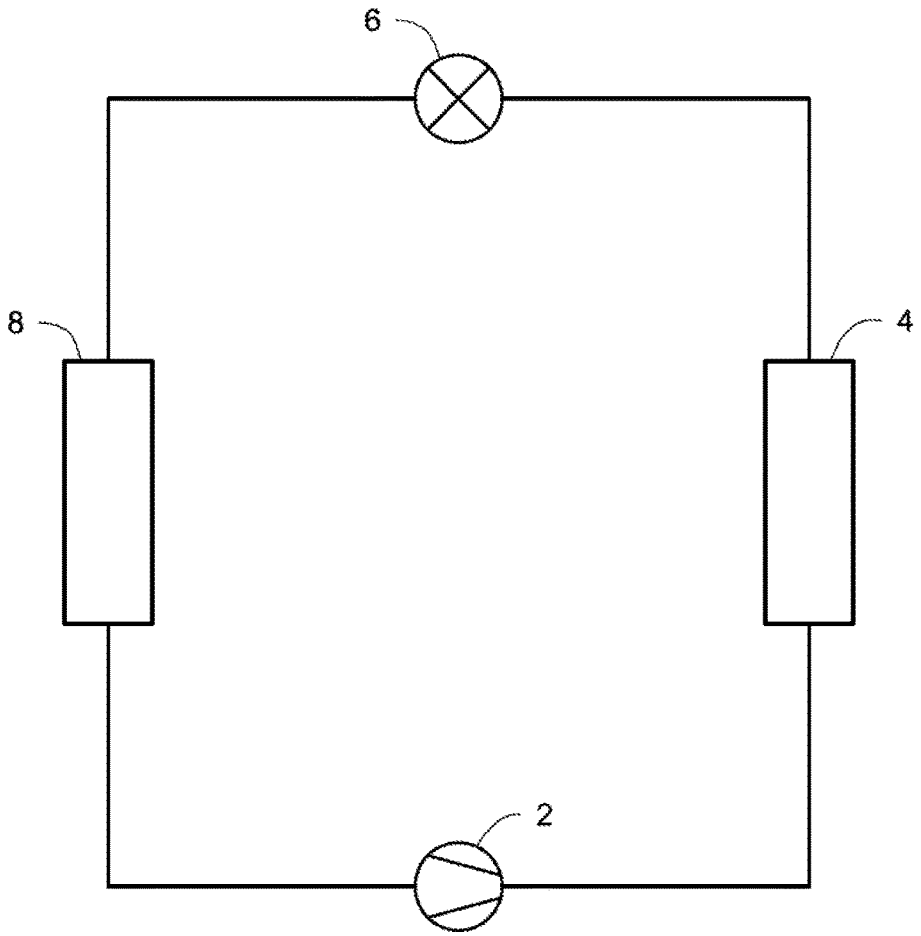
FIG. 1 shows a schematic view of a refrigerant circuit.

FIG. 1 is a schematic diagram of a refrigerant circuit, according to an embodiment. The refrigerant circuit generally includes a compressor 2, a condenser 4, an expansion device 6, and an evaporator 8. The compressor 2 can be a positive displacement compressor, for example, a scroll compressor, a screw compressor, or a rotary vane compressor. The refrigerant circuit is an example and can be modified to include additional components. For example, in an embodiment, the refrigerant circuit can include other components such as, but not limited to, an economizer heat exchanger, one or more flow control devices, a receiver tank, a dryer, a suction-liquid heat exchanger, or the like.

The refrigerant circuit can generally be applied in a variety of systems used to control an environmental condition (e.g., temperature, humidity, air quality, or the like) in a space (generally referred to as a conditioned space). Examples of such systems include, but are not limited to, HVACR systems, transport refrigeration systems, or the like.

The compressor 2, condenser 4, expansion device 6, and evaporator 8 are fluidly connected. The refrigerant circuit can operate according to generally known principles. The refrigerant circuit can be configured to heat or cool a liquid process fluid (e.g., a heat transfer fluid or medium such as, but not limited to, water, glycol, or the like), in which case the refrigerant circuit may be generally representative of a liquid chiller system. The refrigerant circuit can alternatively be configured to heat or cool a gaseous process fluid (e.g., a heat transfer medium or fluid such as, but not limited to, air or the like), in which case the refrigerant circuit may be generally representative of an air conditioner or heat pump.

In operation, the compressor 2 compresses a working fluid (e.g., a heat transfer fluid such as a refrigerant or the like) from a relatively lower pressure gas to a relatively higher-pressure gas. The relatively higher-pressure gas is also at a relatively higher temperature, which is discharged from the compressor 2 and flows through the condenser 4. The working fluid flows through the condenser 4 and rejects heat to a process fluid (e.g., air or the like), thereby cooling the working fluid. The cooled working fluid, which is now in a liquid form, flows to the expansion device 6. In an embodiment in which the condenser 4 includes a subcooler portion, the liquid working fluid can flow through the subcooler portion prior to flowing to the expansion device 6. In the subcooler portion, the working fluid may be further subcooled. The expansion device 6 reduces the pressure of the working fluid. As a result, a portion of the working fluid is converted to a gaseous form. The working fluid, which is now in a mixed liquid and gaseous form flows to the evaporator 8. The working fluid flows through the evaporator 8 and absorbs heat from a process fluid (e.g., water, glycol, air, or the like) heating the working fluid, and converting it to a gaseous form. The gaseous working fluid then returns to the compressor 2. The above-described process continues while the refrigerant circuit is operating, for example, in a cooling mode (e.g., while the compressor 2 is enabled).

The compressor 2 produces vibrations during operation, which may include both vibration of the compressor itself which may be transferred through mechanical linkages to other parts of the system, and vibration in the compressed working fluid exiting the discharge of the compressor 2. One or more vibration control devices may be located along the refrigerant circuit to control one or both of these vibration sources. In an embodiment, the vibration control device may be located between the compressor 2 and the condenser 4.

Figure 2:
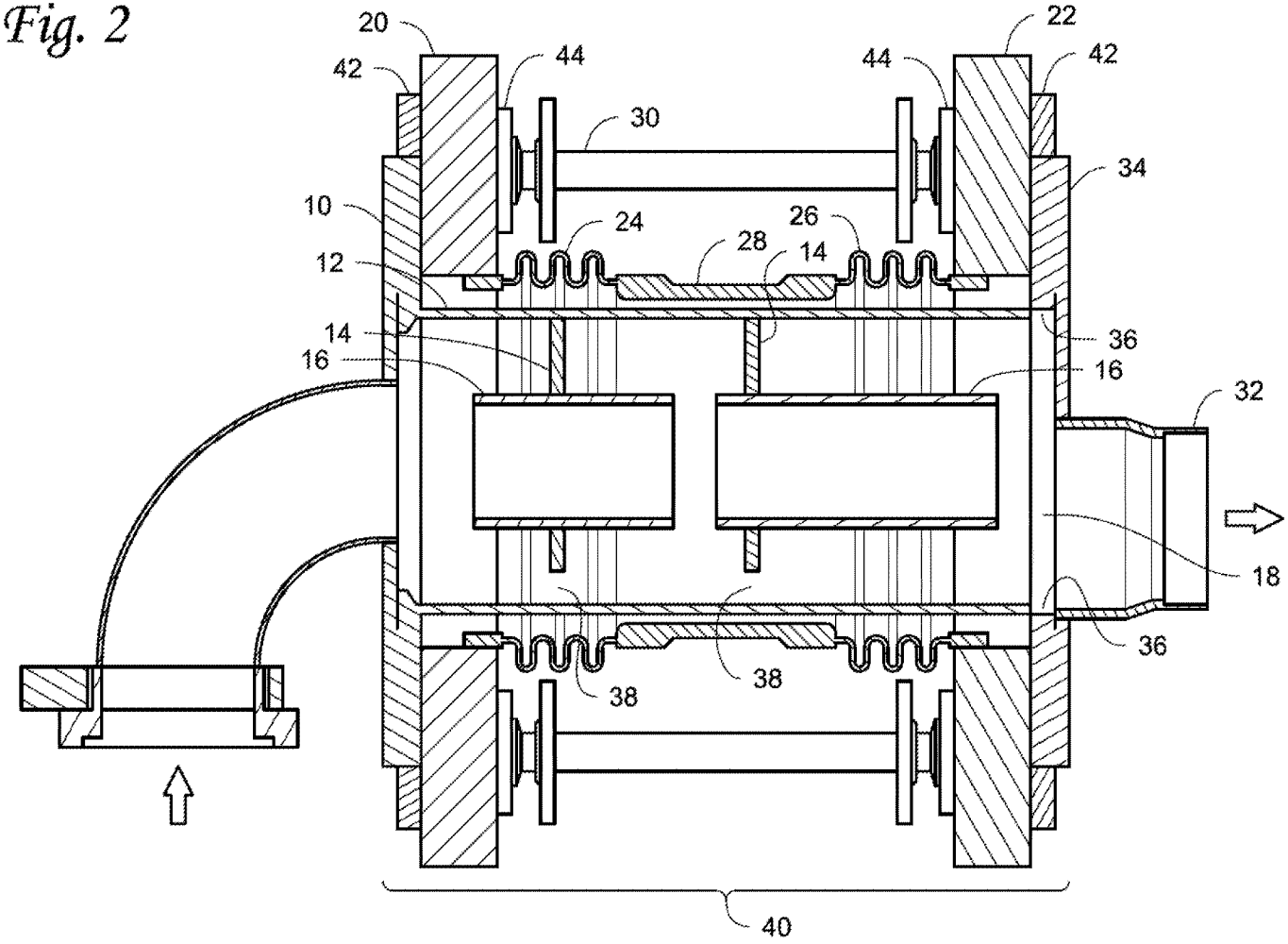
FIG. 2 shows a side view of an embodiment installed in a compressor system.

FIG. 2 is a cutaway side view of an embodiment. A muffler portion includes a muffler flange 10 and a muffler body 12. The muffler body 12 contains one or more vibration attenuation structures. In the embodiment shown in FIG. 2, the vibration attenuation structures are baffles which each include a baffle plate 14 and a tube 16. The baffle plate 14 may have a cutout 38 in a portion of the side where it is joined to the muffler body 12. The muffler body 12 extends to a muffler free end 18. A bellows assembly 40 includes a compressor-side attachment 20, a discharge line side attachment 22, a first convolution 24, a second convolution 26, a middle section 28 and one or more structural supports 30. The discharge line 32 may include a discharge line flange 34, and a gap 36 exists between the discharge line and the free end of the muffler body 12.

Muffler flange 10 extends from the muffler body 12 at a first end of the muffler body 12 which is in proximity to or connected to the compressor. Muffler flange 10 may be located at an end of the muffler body 12 which is at a first end closest to the compressor with regards to the direction of fluid flow through the muffler. The muffler flange 10 may extend radially from the outer surface of that end of the muffler body 12. In an embodiment, there may be multiple muffler flanges 10, with spaces between them, each extending radially from the outer surface of the end of the muffler body 12. The attachment of the bellows assembly 40 to the muffler flange or flanges 10 may be, for example, bolts or welding. In an embodiment, there may be through holes for bolts formed in the muffler flange 10.

Muffler body 12 extends from the muffler flange 10 towards the discharge line 32. The muffler body 12 contains one or more vibration attenuation structures. Examples of vibration attenuation structures may be found in Martinus, U.S. Pat. No. 9,423,149, which is herein incorporated by reference in its entirety. In the embodiment shown in FIG. 2, the vibration attenuation structures may be one or more baffles which may each include a tube 16 and a baffle plate 14. The baffle plate 14 extends from an inside surface of the muffler body 12 towards the center of the muffler body 12. The baffle plate 14 is joined to tube 16. In an embodiment, the muffler body 12 may have a cylindrical outer surface. In an embodiment, the muffler body 12 may be surrounded by at least a portion of the bellows assembly 40. For example, the muffler body may be surrounded by convolutions 24 and 26 and middle section 28 of the bellows assembly 40. The bellows assembly 40 may surround the muffler body 12 such that no portion of the bellows assembly 40 directly contacts the outer surface of the muffler body 12.

In an embodiment, vibration attenuation structures may include, for example, an acoustic path with one or more contracted portions, absorbent materials within an acoustic path, or a perforated plate in the acoustic path and having one or more holes through the plate, or combinations of those features. Examples of acoustic paths through the muffler body 12 which may be used as vibration attenuation structures are provided in FIGS. 2A through 2E.

Compressors used in HVACR systems, such as screw compressors, may produce vibrations across a range of frequencies. Wave attenuation features may be directed to particular frequencies, such as, for example, 200 Hz or 400 Hz for fixed speed compressors. Variable speed compressors may have wider ranges of frequencies of vibration, for example ranging from 200 Hz to 16,000 Hz. In an embodiment, specific frequencies within the range of frequencies for the compressor may be selected for attenuation. The selection of frequencies may be based on, for example, the typical operating profile for the compressor and frequency or range of frequencies of vibration most represented during standard operations. In an embodiment, the frequencies may be selected based on the amplitude of vibration at that frequency or range of frequencies. In an embodiment, the frequencies may be selected based on human perception of the tone produced by vibrations at that frequency or range of frequencies.

Muffler body 12 terminates at muffler free end 18. Muffler free end 18 may be on the discharge line 32 side of the muffler body. The muffler free end 18 includes an opening which is located in proximity to the discharge line 32. Muffler free end 18 and discharge line 32 are separated by a gap 36. The gap 36 may be between approximately one quarter of an inch and approximately one inch. The opening at the free end 18 allows fluid from the muffler body 12 to enter the discharge line 32. Gap 36 isolates the discharge line 32 from vibrations of the muffler body 12. The gap 36 may be sized based on the magnitude of the vibrations of the free end 18 relative to the discharge line 32, to ensure isolation of vibration in the free end while limiting the quantity of fluid that may escape through the gap 36.

Baffles are an example of a vibration attenuation structure which may be located within the muffler body 12. In the embodiment shown in FIG. 2, each of the baffles includes a baffle plate 14 and a tube 16.

Baffle plates 14 extend from an inner surface of the muffler body 12 towards the center of the muffler body 12. The baffle plates 14 may terminate where they meet the tubes 16. The flanges may be fixed to the muffler body 12 by, for example, welding. The side of the baffle plate 14 contacting the muffler body may include a cutout 38. The shape and size of the cutout may be based on the frequencies of vibration to attenuate through use of the muffler. The length of the baffle plate, and correspondingly the distance between the inside wall of the muffler body 12 and the tube 16 may be determined based on the frequency or range of frequencies of vibration to be attenuated.

Tubes 16 are connected to the baffle plates 14. The connection may be, for example, a weld. In an embodiment, the tube 16 and baffle plate 14 may instead be formed as a single piece. Each tube 16 forms an angle with the baffle plate 14 it is connected to, such as a right angle. In an embodiment, the angle between the baffle plate 14 and the tube 16 may be selected based on the frequency or range of frequencies of vibration to be attenuated by the vibration attenuation structures within the muffler body 12. The length of the tube 16 before and following the baffle plate 14 with respect to a direction of fluid flow through the muffler body 12 may be determined based on the frequency or range of frequencies of vibration which are to be attenuated by the vibration attenuation structures within the muffler body 12. In an embodiment, the angles between the baffle plate 14 and the tube 16, and the lengths of the portions of the tube 16 in front of and following the baffle plate 14 with respect to a fluid flow through the muffler body 12 may vary between different baffles located within the muffler body 12.

Bellows assembly 40 is a vibration damping system which, in an embodiment, includes a compressor-side attachment portion 20, a discharge-line side attachment portion 22, a first convolution 24, a middle section 28, a second convolution 26, and one or more structural supports 30 surrounding the bellows.

The compressor-side attachment portion 20 is a portion of the bellows assembly 40 where the bellows assembly 40 may be connected to the muffler flange 10. In an embodiment, the compressor-side attachment portion 20 may have a flat surface for contacting the muffler flange 10. The compressor-side attachment portion 20 may, in an embodiment, include a space in which to weld the attachment portion 20 to the muffler flange 10. In an embodiment, the compressor-side attachment portion 20 may have holes through which it is bolted to the muffler flange 10. The discharge line-side attachment portion 22 is at the opposite side of the bellows assembly 40 from the compressor-side attachment portion 20. In an embodiment, the discharge-line side attachment portion 22 may include a surface contacting the discharge line flange 34. The discharge line-side attachment portion may be attached to a portion of the discharge line 32, for example a discharge line flange 34, through welding, bolts, or other methods of mechanically connecting the discharge line-side attachment portion 22 to the discharge line flange 34.

The bellows assembly 40 includes a vibration isolation conduit, which may include a first convolution 24, a middle section 28, and a second convolution 26. The convolutions 24 and 26 allow more expansion along a center axis of the bellows assembly 40. The convolutions 24 and 26 also allow lateral movement along the center axis of bellows assembly 40. The convolutions 24 and 26 provide flexible portions of the vibration isolation conduit. The flexibility of the convolutions 24 and 26 may store and dissipate vibrational energy. Examples of vibration isolation conduits which may be used in an embodiment of bellows assembly 40 may be found in Mehta, U.S. Patent Application Pub. No. 2015/0192310, which is herein incorporated by reference in its entirety.

Middle section 28 of the vibration isolation conduit may be a segment between the first convolution 24 and the second convolution 26. The middle section 28 may be ring-shaped, with a diameter larger than the diameter of the muffler body 12, such that when the bellows assembly 40 is connected to the muffler flange 10 that the middle section 28 surrounds a portion of the muffler body 12.

The first convolution 24, the second convolution 26, and the middle section 28 may be sized such that the muffler body 12 can fit within those portions of the bellows assembly 40. In an embodiment, the bellows assembly 40 may be slipped over the outside of the muffler body 12, with no contact between the bellows assembly 40 and the muffler body 12. By placing the bellows assembly 40 over the muffler body 12, the space occupied by the muffler and bellows assembly 40 can be reduced. In an embodiment, the bellows assembly 40 may be placed over the muffler body 12 during assembly of an HVACR system at a site, for example a rooftop unit atop a commercial building. The middle section 28 may be rigid, for example a steel tube. The convolutions 24 and 26 may be, for example, flexible materials, such as multiple layers of metal such as copper and/or steel.

Structural supports 30 may extend across the bellows assembly 40, for example between an end cap on a compressor side and an end cap on a discharge line side of the bellows assembly 40. In an embodiment, end caps 42 of the bellows assembly 40 may be bolted to the structural supports 30. The structural supports 30 maintain a length of the bellows assembly 40. The structural supports 30 may maintain a length of the bellows assembly 40 and maintain the general shape of the convolutions 24 and 26. In an embodiment, the structural supports 30 may extend from the compressor-side attachment portion 20 to the discharge line-side attachment portion 22. The structural supports 30 may be rigid structures such as steel tie rods. The bellows assembly 40 may include vibration isolation members 44 between the structural supports 30 and the other portions of the bellows assembly 40 to reduce the transfer of vibrational energy to and through the structural supports 30. The vibration isolation members 44 may be made of elastic materials such as rubber or neoprene.

Discharge line 32 is a line by which fluid exiting the muffler may be communicated to another device such as a heat exchanger as the fluid travels away from the compressor. The discharge line has an inlet, which is separated from the free end 18 of the muffler body 12 by a gap 36. The gap 36 is sized to reduce loss of fluid when communicating the fluid from inside the muffler body 12 to the discharge line 32, while isolating the muffler body 12 from the discharge line 32 to prevent the transmission of vibration. The gap 36 may range from approximately one quarter of an inch to approximately one inch.

The discharge line 32 may have one or more discharge line flanges 34 providing a region for attachment of the bellows assembly 40, to which one or more discharge line-side attachment portions 22 may be connected. The attachment portion 22 may be connected to the discharge line flange 34 by, for example by welds or bolts. There may be one or more discharge line flanges 34 extending from the discharge line 32. Where there is one discharge line flange, it may be circular, extending radially outwards from the inlet of the discharge line 32. In an embodiment where there is more than one discharge line flange 34, the discharge line flanges 34 extend radially from the discharge line 32 with spaces between the flanges multiple flanges. In an embodiment, the discharge line flange 34 may include holes for installing bolts to connect the discharge line-side attachment portion 22 of the bellows assembly 40 to the discharge line flange 34, or areas where the discharge line flange 34 may be welded to the discharge line-side attachment portion 22 of the bellows assembly 40.

FIG. 3A through 3E show examples of vibration attenuation structures which may be included within the muffler body in embodiments. FIGS. 3A through 3E show schematic diagrams of the acoustic path through which fluid passes following its entry into the muffler body from a compressor. The acoustic paths shown in FIGS. 3A through 3E may be used instead of or in addition to the baffle plates 14 and tubes 16 shown in FIG. 2 as the vibration attenuation structure within the muffler body 12. The acoustic paths in FIGS. 3A-3E may be combined with one another or with the baffles plates 14 and tubes 16 shown in FIG. 2. Further vibration reduction methods may also integrated within the muffler body, such as placing sound-absorbing material along the inner wall of the muffler body.

Figure 3A:
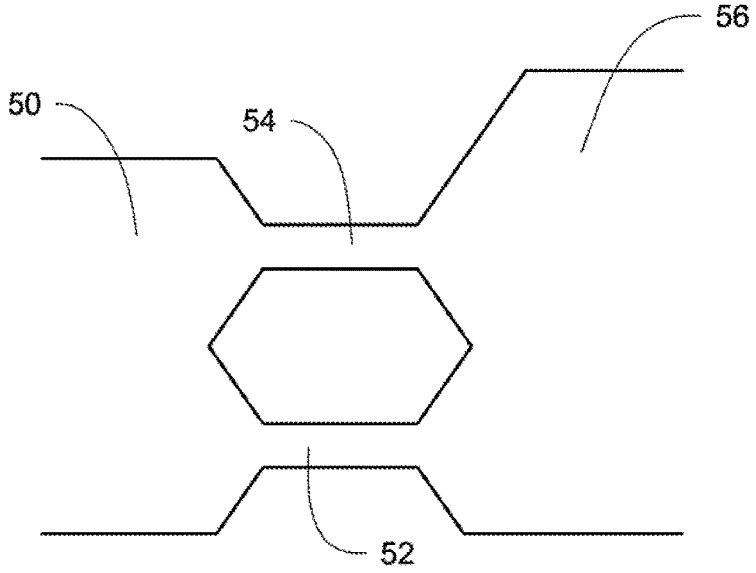
FIGS. 3A-3E show cutaway schematic side views of acoustic paths which may be used within embodiments of a muffler.

FIG. 3A shows an embodiment of an acoustic path where there are multiple contracted portions of the acoustic path 52 and 54 parallel. The contracted portions 52 and 54 may each have different sizes or dimensions such as diameters or cross-sectional areas from one another. The acoustic path may, in an embodiment, be expanded on one side of the contracted portions 52 and 54, for example as shown in this figure where the second end of the acoustic path 56 is expanded in comparison with first end of the acoustic path 50. The expanded portions of the acoustic path 50 and 56, the contracted portions of the acoustic path 52 and 54, and differences in the size of 50, 52, 54, and 56 may all serve to shift the phase of acoustic waves and reduce the overall amplitude of acoustic vibrations as they travel through the acoustic path.

Figure 3B:
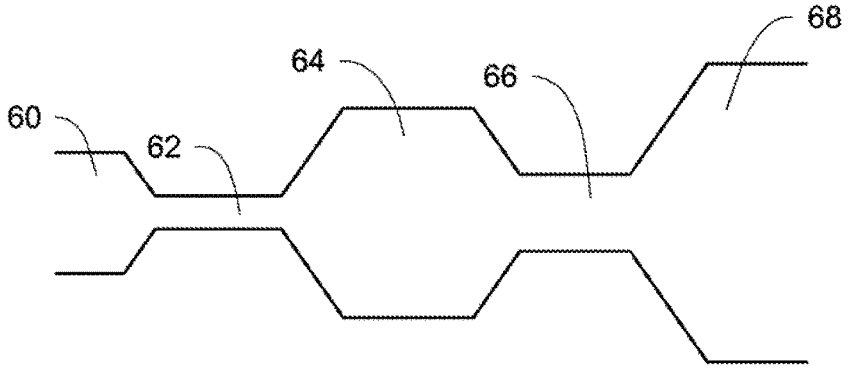

FIG. 3B shows an embodiment where multiple contracted portions 62 and 66 are in series. The contracted portions may have an expanded portion 64 between them. The expanded portion 64 may have a larger size (e.g. cross-sectional area) that the first end 60 or the second end 68 of the acoustic path. The expansions and contractions of this path through the muffler body 12 may shift the phase of acoustic waves in the acoustic path, reducing the overall amplitude of the acoustic vibration.

Figure 3C:
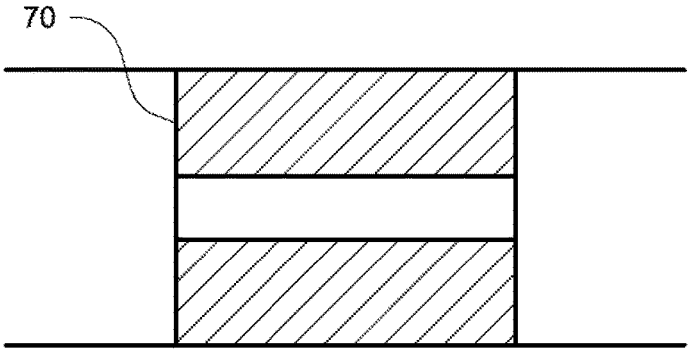

FIG. 3C shows an embodiment where a material which absorbs acoustic waves is placed along the acoustic path. The material may be, for example, a ring 70 of material within the acoustic path. The material of ring 70 may absorb some of the vibration, and/or may cause a shift in the phase of acoustic waves, reducing the overall amplitude of the acoustic vibration.

Figure 3D:
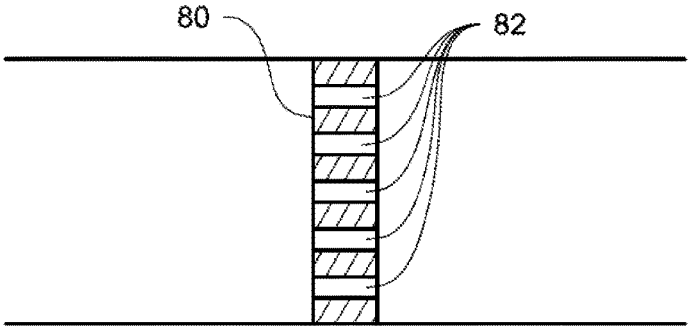

FIG. 3D shows an embodiment where a perforated plate 80 is in the acoustic path. The plate 80 has a plurality of apertures 82. The phases of acoustic waves may be shifted as they travel through the plate and the apertures, causing a reduction in amplitude of the vibrations.

Figure 3E:
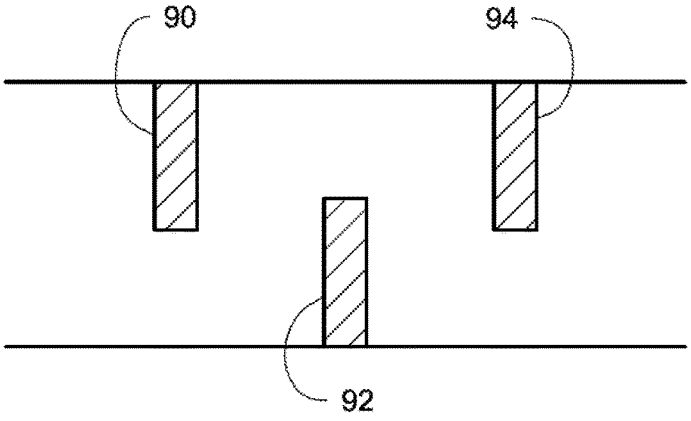

FIG. 3E shows an acoustic path with one or more baffles 90, 92 and 94. The one or more baffles 90, 92 and 94 may, for example, be blocks or incomplete rings within the acoustic path. The one or more baffles 90, 92 and 94 may direct the acoustic waves or alter their phase, reducing the overall amplitude of vibration.

Figure 4:
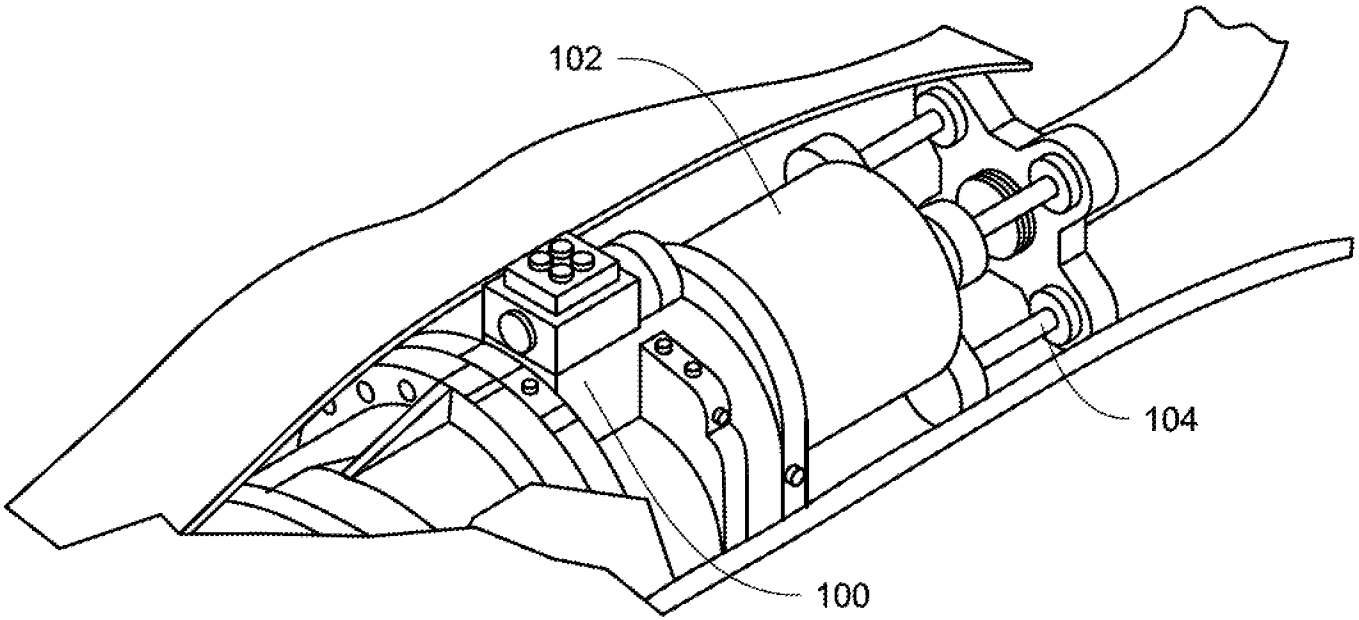
Fig. 4 (Prior Art)
FIG. 4 shows a diagram of a prior art configuration of compressor, muffler and bellows.

FIG. 4 is an example of a prior art configuration of a muffler and bellows for a compressor. The compressor 100 is connected to a muffler 102, and the muffler is in series with the bellows 104. This arrangement requires space for both the muffler 102 and the bellows 104 between the compressor 100 and the destination of the discharge line, increasing the size of current designs incorporating the muffler 102 and bellows 104 separately. The space required for the muffler 102 and bellows 104 in series may be too large for incorporation into pre-existing designs of compressor systems, and may prevent those designs from benefitting from the vibration reduction offered by combining the two.

Aspects:

It is to be recognized that any of aspects 1-13 may be combined with any of aspects 14-20.

Aspect 1. A pulsation and vibration control device, comprising:

a muffler unit, comprising:

a flange on a compressor end;

a muffler body containing at least one vibration attenuation structure; and a free end opposite the compressor end; and a bellows assembly surrounding the muffler body, wherein the bellows assembly is attached to the flange and extends from the flange to a discharge line; and wherein the free end of the muffler and the discharge line do not contact one another.

Aspect 2. The pulsation and vibration control device according to aspect 1, wherein a gap between the free end of the muffler and the discharge line is between approximately one inch and approximately one quarter of an inch.

Aspect 3. The pulsation and vibration control device according to any of aspects 1-2, wherein a gap between the free end of the muffler and the discharge line is approximately one quarter of an inch.

Aspect 4. The pulsation and vibration control device according to any of aspects 1-3, wherein the at least one vibration attenuation structure comprises a plurality of baffles are located within the muffler body.

Aspect 5. The pulsation and vibration control device according to aspect 4, wherein the each of the plurality of baffles comprises a baffle plate and a tube.

Aspect 6. The pulsation and vibration control device according to aspect 5, wherein for each baffle, the baffle plate and the tube are joined at an approximately 90 degree angle.

Aspect 7. The pulsation and vibration control device according to any of aspects 5-6, wherein a height of the baffle plate and a length of the tube are selected based on a targeted frequency of vibration to attenuate.

Aspect 8. The pulsation and vibration control device according to any of aspects 5-7, wherein the baffle plate has a cutout on a side of the baffle plate joined to the body of the muffler.

Aspect 9. The pulsation and vibration control device according to any of aspects 1-8, wherein the at least one vibration attenuation structure comprises a plurality of contracted portions of a path through the muffler body.

Aspect 10. The pulsation and vibration control device according to aspect 9, wherein the contracted portions of a path through the muffler body are in parallel with one another.

Aspect 11. The pulsation and vibration control device according to any of aspects 9-10, wherein the contracted portions of a path through the muffler body are in series with one another.

Aspect 12. The pulsation and vibration control device according to any of aspects 1-11, wherein the bellows assembly further comprises:

a first convolution;

a second convolution;

a middle section connected to the first convolution and the second convolution;

a compressor-side mounting, connected to the flange of the muffler unit; and a discharge line-side mounting, connected to the discharge line.

Aspect 13. The pulsation and vibration control device according to aspect 12, wherein the bellows assembly further comprises one or more structural supports extending from the compressor-side mounting to the discharge line-side mounting.

Aspect 14. A pulsation and vibration control system, comprising:

a muffler unit, comprising a muffler flange at a first end, a muffler body containing at least one vibration attenuation structure and having an outer surface, and a second end, wherein the muffler body has an opening at the second end; and a bellows assembly, comprising a convolution and an internal space and wherein the bellows assembly has a length equal to or greater than the outer surface of the muffler body and wherein the internal space has a volume that is larger than a volume defined by the outer surface of the muffler body.

Aspect 15. A pulsation and vibration control system according to aspect 14, further comprising a discharge line, wherein the bellows assembly extends past the muffler body on the second end, and a gap between the second end of the muffler and the discharge line is between approximately one inch and approximately one quarter of an inch.

Aspect 16. The pulsation and vibration control system according to aspect 15, wherein the gap between the second end of the muffler and the discharge line is approximately one quarter of an inch.

Aspect 17. The pulsation and vibration control system according to any of aspects 14-16, wherein the at least one vibration attenuation structure comprises a plurality of baffles.

Aspect 18. The pulsation and vibration control system according to aspect 17, wherein the each of the plurality of baffles comprises a baffle plate and a tube.

Aspect 19. The pulsation and vibration control system according to any of aspects 14-18, wherein the at least one vibration attenuation structure comprises a plurality of contracted portions of a path through the muffler body.

Aspect 20. The pulsation and vibration control system according to any of aspects 14-19, wherein the bellows assembly further comprises:

a second convolution;

a middle section connected to the first convolution and the second convolution;

a compressor-side mounting; and a discharge line-side mounting.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A pulsation and vibration control device, comprising:

a muffler unit, comprising:

a flange on a compressor end;

a muffler body extending from a first part of the flange towards a discharge line and containing at least one vibration attenuation structure; and a free end opposite the compressor end; and a bellows assembly surrounding the muffler body, wherein the bellows assembly is attached to the flange at a second part, different than the first part, and extends from the flange to the discharge line; and wherein the muffler body and the bellows assembly do not contact one another and the free end of the muffler and the discharge line do not contact one another.

2. The pulsation and vibration control device of claim 1, wherein a gap between the free end of the muffler and the discharge line is between approximately one inch and approximately one quarter of an inch.

3. The pulsation and vibration control device of claim 1, wherein a gap between the free end of the muffler and the discharge line is approximately one quarter of an inch.

4. The pulsation and vibration control device of claim 1, wherein the at least one vibration attenuation structure comprises a plurality of baffles are located within the muffler body.

5. The pulsation and vibration control device of claim 4, wherein the each of the plurality of baffles comprises a baffle plate and a tube.

6. The pulsation and vibration control device of claim 5, wherein for each baffle, the baffle plate and the tube are joined at an approximately 90 degree angle.

7. The pulsation and vibration control device of claim 5, wherein a height of the baffle plate and a length of the tube are selected based on a targeted frequency of vibration to attenuate.

8. The pulsation and vibration control device of claim 5, wherein the baffle plate has a cutout on a side of the baffle plate joined to the body of the muffler.

9. The pulsation and vibration control device of claim 1, wherein the at least one vibration attenuation structure comprises a plurality of contracted portions of a path through the muffler body.

10. The pulsation and vibration control device of claim 9, wherein the contracted portions of a path through the muffler body are in parallel with one another.

11. The pulsation and vibration control device of claim 9, wherein the contracted portions of a path through the muffler body are in series with one another.

12. The pulsation and vibration control device of claim 1, wherein the bellows assembly further comprises:

a first convolution;

a second convolution;

a middle section connected to the first convolution and the second convolution;

a compressor-side mounting, connected to the flange of the muffler unit; and a discharge line-side mounting, connected to the discharge line.

13. The pulsation and vibration control device of claim 12, wherein the bellows assembly further comprises one or more structural supports extending from the compressor-side mounting to the discharge line-side mounting.

14. A pulsation and vibration control system, comprising:

a muffler unit, comprising a muffler flange at a first end, a muffler body extending from a first part of the muffler flange and containing at least one vibration attenuation structure and having an outer surface, and a second end, wherein the muffler body has an opening at the second end; and a bellows assembly, comprising a convolution and an internal space and wherein the bellows assembly has a length equal to or greater than the outer surface of the muffler body and wherein the internal space has a volume that is larger than a volume defined by the outer surface of the muffler body, wherein the bellows assembly is connected to the muffler flange at a second part, different from the first part, and wherein the bellows assembly and the muffler body do not contact one another.

15. The pulsation and vibration control system of claim 14, further comprising a discharge line, wherein the bellows assembly extends past the muffler body on the second end, and a gap between the second end of the muffler and the discharge line is between approximately one inch and approximately one quarter of an inch.

16. The pulsation and vibration control system of claim 15, wherein the gap between the second end of the muffler and the discharge line is approximately one quarter of an inch.

17. The pulsation and vibration control system of claim 14 wherein the at least one vibration attenuation structure comprises a plurality of baffles.

18. The pulsation and vibration control system of claim 17, wherein the each of the plurality of baffles comprises a baffle plate and a tube.

19. The pulsation and vibration control system of claim 14, wherein the at least one vibration attenuation structure comprises a plurality of contracted portions of a path through the muffler body.

20. The pulsation and vibration control system of claim 14, wherein the bellows assembly further comprises:

a second convolution;

a middle section connected to the first convolution and the second convolution;

a compressor-side mounting; and a discharge line-side mounting.

* * * * *